United States Patent [19]

Korzeniewski

[11] 3,984,917

[45] Oct. 12, 1976

[54] GUN SIGHT

[76] Inventor: Robert N. Korzeniewski, 115 N. Live Oak St., Carthage, Tex. 75633

[22] Filed: Aug. 26, 1974

[21] Appl. No.: 500,378

[52] U.S. Cl. ..... 33/260; 33/244

[51] Int. Cl.[2] ..... F41G 1/00

[58] Field of Search ..... 33/233, 241, 242, 243, 33/244, 252, 254, 259, 260, 257, 258

[56] References Cited

UNITED STATES PATENTS

| | | | |
|---|---|---|---|
| 962,596 | 8/1909 | Sober | 33/233 |
| 3,386,171 | 6/1968 | Luebkeman | 33/233 |
| 3,748,744 | 7/1973 | McClenahan | 33/257 |
| 3,834,035 | 9/1974 | Merrill | 33/241 |

*Primary Examiner*—Richard E. Aegerter
*Assistant Examiner*—Steven L. Stephan
*Attorney, Agent, or Firm*—Whittemore, Hulbert & Belknap

[57] ABSTRACT

A combat gun sight for horizontal and vertical sighting of weapons such as police pistols, also functioning as a guard for a front post sight including side posts on opposite sides of and in equally spaced relation to a center post whereby in use a target is bracketed between the side posts for horizontal aim and the position of the side posts with respect to a rear gun sight provides vertical aim when the center post is obscured such as by a dark target.

In one modification, an associated rear sight has notches in the upper corners thereof to expose the side posts of the combat gun sight. In a further modification, the side posts of the combat gun sight are adjustable toward and away from the center post.

9 Claims, 14 Drawing Figures

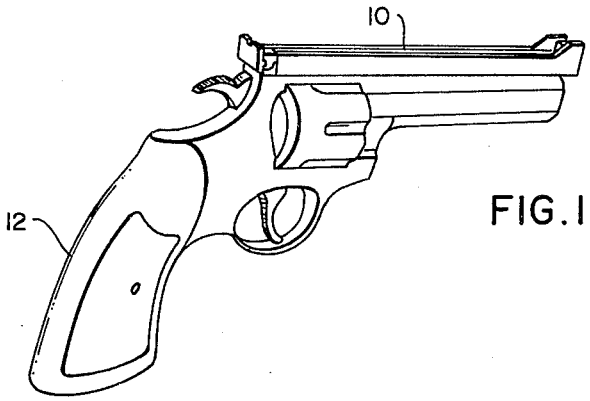
FIG. 1
FIG. 2
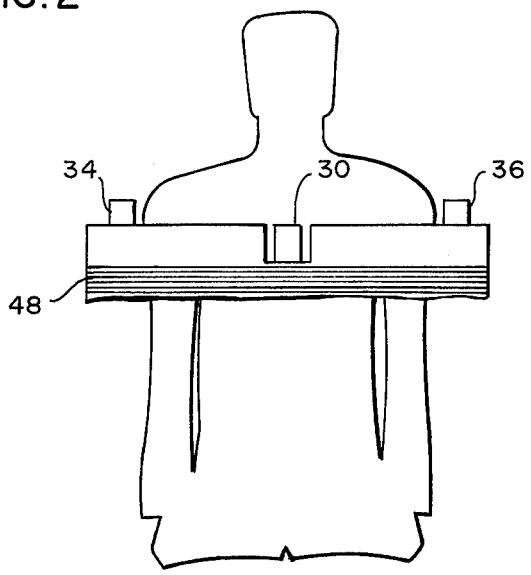
FIG. 3
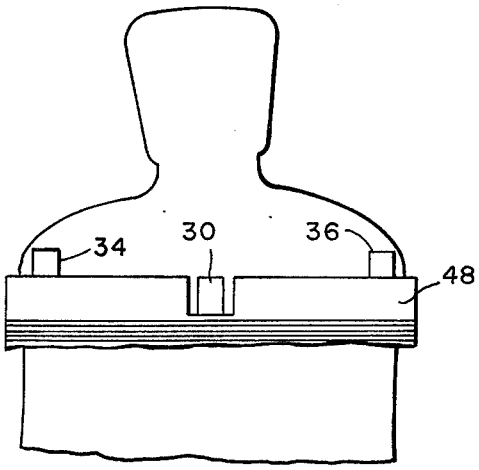
FIG. 4
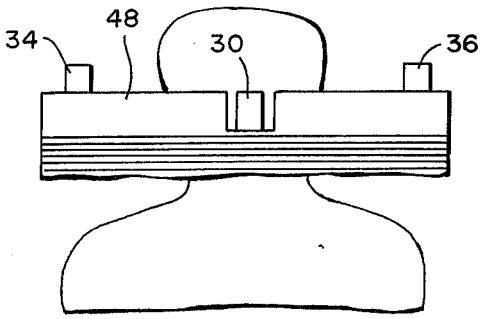

GUN SIGHT

BACKGROUND OF THE INVENTION

1. Field of the Invention

The invention relates to gun sights and refers more specifically to a combat gun sight having a center post and two side posts in spaced relation to and on opposite sides of the center post capable of bracketing a target to provide horizontal aim and for providing vertical aim of a weapon on which the gun sight is installed in accordance with the relative position of the top of the side posts and a rear gun sight when the center post of the gun sight is obscured.

2. Description of the Prior Art

In the past, combat shooting weapons have generally been provided with a centrally located front post sight and a rear sight having a centrally located notch therein in which the front post sight is aligned while the front post sight is maintained on the target. Such gun sights and sighting methods have been deficient in combat shooting where the target is usually dark so that the front post, rear sight and target are substantially merged.

Further, with previous sights it has generally been necessary to lower the rear sight to provide accurate shooting as the distance to the target becomes smaller.

In addition, with combat weapons of the past the front post sight has not usually been provided with guard means so that the front post sight may become damaged in use by being knocked against hard objects and consequently being bent out of shape.

SUMMARY OF THE INVENTION

The invention is a gun sight which in its simplest form includes a pair of side posts, one on each side of and in spaced relation to a front sight center post. The gun sight of the invention may have an included rear sight or the gun sight of the invention may be only the front sight of a weapon used in conjunction with a normal rear sight of the weapon. The sight may include a ramp of variable length depending on the structure of the weapon on which the sight is secured and whether the combat sight is only a front sight or also includes a rear sight.

The method of use of the combat sight includes horizontal sighting of the weapon by bracketing a portion of the target between the side posts of the sight and vertically aligning the weapon by positioning the tops of the side posts in predetermined relation to the top of an associated back sight on the weapon. The side posts provide guards for the center post in use.

In one modification of the gun sight of the invention, notches are provided at the upper corners of the associated rear sight to expose the side posts in use.

In another modification of the combat sight of the invention, means are provided for moving the side posts toward or away from the center post.

In sighting with the combat gun sight of the invention, as the target comes substantially closer to the shooter, a smaller portion of the target is bracketed by the side posts and the associated rear sight is adjusted to compensate for the vertical difference in the position of the portion of the target bracketed.

BRIEF DESCRIPTION OF THE DRAWINGS

FIG. 1 is a perspective view of a pistol having the combat gun sight of the invention secured thereto.

FIG. 2 is a diagrammatic representation of a target being sighted with a combat gun sight such as illustrated in FIG. 1 in conjunction with an associated rear sight.

FIG. 3 is a view similar to FIG. 2 with the target in a closer relationship to the weapon.

FIG. 4 is a diagrammatic view of the combat gun sight and associated rear sight similar to FIGS. 2 and 3 with the combat gun sight bracketing a different portion of the target in accordance with the sighting method of the invention.

DESCRIPTION OF THE PREFERRED EMBODIMENTS

The combat gun sight 10 of the invention is shown in FIG. 1 installed on a pistol 12. In use, the combat gun sight 10 may be used to provide horizontal and vertical aiming of the pistol 12 in situation where the front center post of the sight 10 is obscured as by a darkened target.

Figure 5:
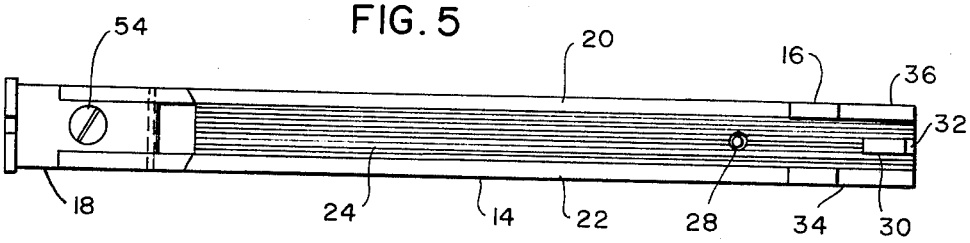
FIG. 5 is a top view of one embodiment of the combat gun sight of the invention.

Referring particularly to FIG. 5, the gun sight 10 includes a central ramp portion 14 which supports a front sight portion 16 at the front end thereof and an associated rear sight 18 at the back end thereof.

The ramp 14 is not unusual and includes side bevels 20 and 22 at the upper edges thereof. Longitudinally extending grooves 24 are provided between the beveled upper edges 20 and 22 as shown. The ramp portion 14 is provided with a suitably arcuate bottom surface 26 to permit installation of the gun sight 10 on pistols 12 having an arcuate barrel. It will be understood that other bottom surface configurations are contemplated for securing the gun sight 10 to, for example, guns having built-in ramps or ventilating ribs and the like. The gun sight 10 is secured to the pistol 12 as shown in FIG. 1 by convenient means such as headed bolts 28 extending through the gun sight 10 and into the pistol 12 or an associated ramp or the like.

Figure 6:
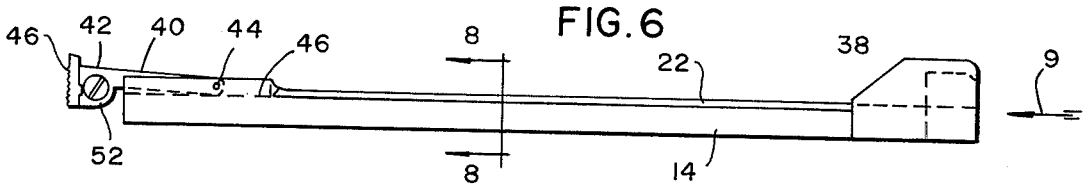
FIG. 6 is an elevation view of the combat gun sight of FIG. 5.
Figure 7:
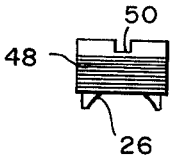
FIG. 7 is one end view of the combat gun sight of FIG. 5.
Figure 8:
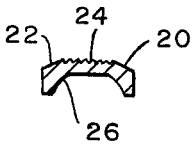
FIG. 8 is a transverse section view of the combat gun sight of FIG. 5 taken substantially on the line 8—8 in FIG. 6.
Figure 9:
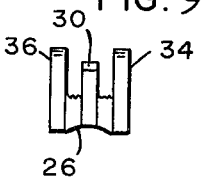
FIG. 9 is an end view of the combat gun sight of FIG. 5 taken in the direction of arrow 9 in FIG. 6.

The front sight portion 16 of the combat gun sight 10 as shown in FIGS. 5 and 6 includes the center post 30 secured in a slot 32 in the ramp 14. The center post 30 may be secured in the slot 32 by convenient means such as welding or the like.

The side posts 34 and 36 are also part of the combat sight 10 and are provided on opposite sides of the center post 30 in spaced relation thereto. The spacing of the side posts from the center post are identical. The side posts 34 may again be secured to the ramp 14 by convenient means such as welding, bolting or the like, and are provided with a beveled corner 38 to prevent catching of the side posts 34 and 36 on a bolster or the like while the pistol 12 is being drawn.

In use, the side posts 34 and 36 provide protection for the center post 30 against being dislocated by bumping hard objects and the like.

The rear sight structure 40 includes a body portion 42 which is pivoted on a pin 44 in a recess 46 in the back end of the ramp 14. A back 48 having a notch 50 in the top surface thereof is provided on the body portion 42 and is adjustable by means of the screw 52 transversely of the pistol 12. The sight back 48 is adjusted vertically of the pistol 12 by means of the adjusting screw 54 operating against the bottom of the recess 46.

Figure 10:
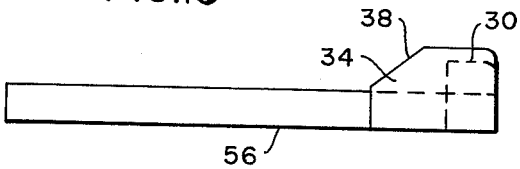
FIG. 10 is an elevation view of a modification of the combat gun sight illustrated in FIG. 5.

The modification 56 of the gun sight 10 illustrated in FIG. 10 includes only the front sight portion and a part of the ramp of the gun sight 10. The front sight portion and ramp of the sight 56 are exactly the same as the corresponding portions of the gun sight 10 and are adapted to be used in conjunction with an associated rear sight already provided on a weapon.

Figure 11:
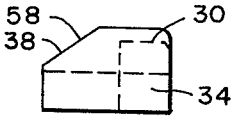
FIG. 11 is an elevation view of a further modification of the combat gun sight illustrated in FIG. 5.

Similarly, the further modified gun sight 53 illustrated in FIG. 11 includes only the front sight portion of the combat sight 10. The combat sight 58 is again used in conjunction with an existing rear sight on a weapon and has particular advantage where the weapon is already provided with a ramp.

Figure 12:
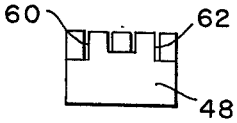
FIG. 12 is an end view of a combat gun sight such as that illustrated in FIG. 1 wherein the rear sight is modified by removal of the upper corners thereof.

As shown in FIG. 12, the rear sight portion of the combat sight 10 or the rear gun sight associated with the combat sights 56 and 58 may be provided with notches 60 and 62 in the sight backs such as the sight back 48 illustrated to expose the front side posts of the combat sights to aid in vertical sighting.

Figure 13:
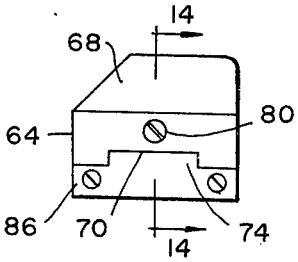
FIG. 13 is an elevation view of a modified combat gun sight such as shown in FIG. 11 wherein the side posts are adjustable.
Figure 14:
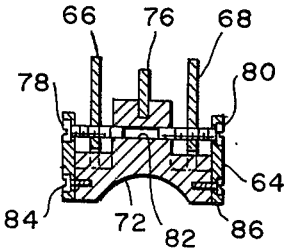
FIG. 14 is a section view of the modified gun sight illustrated in FIG. 13 taken substantially on the line 14—14 in FIG. 13.

In the modified combat sight structure illustrated in FIGS. 13 and 14, the side posts are adjustable toward and away from the center post. Thus, as shown best in FIG. 14, the side posts 66 and 68 are separate pieces which have the general elevation configuration illustrated in FIG. 13 including the notch 70. The sight 64 is further provided with a body portion 72 having a cross section as illustrated in FIG. 14 and including rectangular guide portions 74 on which the posts 66 and 68 are guided by the recesses 70. The posts 66 and 68 are moved toward and away from the center post 76 by adjusting screws 78 and 80 extending into the threaded opening 82 in the body portion 72 and rotatably mounted in the side plates 84 and 86 which may be bolted to the body portion 72 as shown in FIG. 14. The side posts 66 and 68 are threadedly received on the adjusting screws 78 and 80 for fine adjustment toward and away from the center post 76.

If desired, the screws 78 and 80 can be a single screw having oppositely threaded ends whereby the posts 66 and 68 may be mounted for simultaneous movement toward or away from the center post an equal amount on rotation of a single screw from one side of the sight 68.

In use of the combat sight 10, the pistol 12 having the sight 10 secured thereto is pointed in the direction of the target and if the target is light-colored the center post 30 is centered in the notch 50 in the back sight 40 and the top of the center post 30 is aligned with the top of the back plate 48 of the rear sight 40 and the top of the front of the center post 30 is placed on the center of the target.

Where, however, the target is dark so that it is difficult to see the position of the center post in the notch 50 and relative to the back plate 48 of the sight 40, the dark target is centered between the side posts 34 and 36 as shown in FIG. 2 to provide horizontal sighting of the pistol 12. The pistol 12 is then moved to position the tops of the side posts 34 and 36 in a predetermined relation to the top of the back plate 48 of the rear sight 40, which predetermined position will depend at least in part on the relative height of the center post and side posts. That is to say, for example, when the heights of the center post and back plate are the same, the vertical sighting for the pistol will be at an optimum for the set distance of the pistol 12 when the side posts are just even with the top of the back plate of the rear sight 40.

In combat range shooting where the distance is, for example, fixed at 50 yards, the combat sight 10 may be constructed to provide the sight picture illustrated in FIG. 2 at a 50-yard distance.

Where, however, the distance becomes closer, for example, so that the target appears much larger in relation to the sight so that it is impossible to bracket the center of the target with the side posts 34 and 36, as for example shown in FIG. 3, alternate use of the combat sight 10 is recommended.

Thus, as shown in FIG. 4, in such case a smaller portion of the target, for example the head of a man target, may be bracketed between the side posts 34 and 36 of the sight 10 and the vertical sight again accomplished in the manner indicated above after the rear sight has been adjusted to accommodate the change of distance to the target.

Thus, for example, if the head of a man target is being aimed at, as shown in FIG. 4, the shooter should if he desires to hit the center of the man target illustrated in FIG. 2, lower the rear sight a predetermined amount as, for example, by rotating the adjusting screw 54 a predetermined number of revolutions or clicks as is usual with such sights to bring the line of sight of the barrel of the pistol 12 down to the center of the man target when the sights are exactly aligned on the head of the man target.

Wherein the modified sight structure illustrated in FIG. 12 is being used, it will be recognized that it will be easier to determine when the side posts are exactly aligned with the top of the rear sight back plate 48.

Wherein the adjustable side posts are provided, as they may be on any of the gun sights 10, 56 and 58, the position of the side posts 34 and 36, which should be maintained equally spaced from the center post, may be varied to accommodate targets of different size and at various distances.

While one embodiment of the present invention and modifications thereof have been considered in detail, it will be understood that other embodiments and modifications are contemplated by the inventor. It is the intention to include all such embodiments and modifications as are defined by the appended claims within the scope of the invention.

What I claim as my invention is:

1. A gun sight for combat shooting along a line of sight, comprising a front sight portion including a base portion, a front center post extending vertically from the base portion and front side posts extending vertically from the base portion on both sides of the center post and also at least a substantial distance in the direction of the line of sight whereby a portion of a target can be bracketed between the side posts when the center post is obscured to provide horizontal sighting, and a rear sight portion including a full flat back having a linear top extending horizontally over substantially the entire width thereof with a centrally located notch therein to provide vertical sighting in conjunction with the side posts when the center post of the front sight portion is obscured.

2. A gun sight as set forth in claim 1 wherein the side posts are of the same length as the center post and vertical sighting is accomplished by bringing the side posts into alignment with the top of the associated rear gun sight when the center post is obscured.

3. Structure as set forth in claim 1 wherein the side posts are of greater length than the center post and vertical sighting is accomplished by bringing the side posts into a predetermined vertical position with respect to the top of the associated rear gun sight when the center post is obscured.

4. The gun sight as set forth in claim 1 wherein the associated rear gun sight includes notches cut from the sides thereof adjacent the top thereof for exposing the side posts during sighting.

5. The gun sight as set forth in claim 1 wherein the side posts are equidistant from the center post.

6. The gun sight as set forth in claim 1 and further including means for adjusting the side posts toward and away from the center post.

7. A gun sight for combat shooting and the like comprising an elongated ramp having a bottom adapted to be secured to the top of a gun and having a serrated top, a front sight portion having opposite sides extending in the direction of sight, a centrally located vertically extending blade-type center post which is longer in the direction of sight than it is high vertically and having a beveled upper front corner secured to the front end of the front sight portion of the ramp centrally between the sides of the ramp, side posts extending along both sides of the ramp extending vertically above the ramp a distance greater than the height of the center post and extending along the sides of the ramp in the direction of the line of sight substantially twice the dimension of extent of the center post along the line of sight, the front upper edge of the side posts being rounded and the rear upper edge of the side posts from the top of the ramp being beveled toward the front of the side posts, which bevel is terminated prior to the rear of the center post, and a rear sight portion including a recess in the back end of the ramp, a body portion, a pivot pin pivoting the body portion in the recess in the back end of the ramp, a flat serrated back portion having a horizontal top and a notch in the top of the flat back portion, screw means extending between the body portion and the ramp for adjusting the pivoted position of the body portion of the rear sight portion of the gun sight, and screw means extending transversely of the gun sight structure and engaged with the back of the rear sight for adjusting the back of the rear sight portion of the gun sight transversely of the gun sight.

8. A gun sight for combat shooting and the like, comprising a base portion having opposite sides including upper edges extending in the direction of sight, the bottom of which is adapted to fit on the front of a gun, recesses on both upper edges of the base portion extending along the line of sight, rectangular guide portions extending perpendicular to the line of sight across each of the recesses, side posts extending vertically above the base portion and extending along both sides of the base in the direction of the line of sight, which side posts are provided with a complementary recess fitting over the guide portions, side plates secured to the sides of the base portion below the side posts, and screw means extending through the side plates and into the base at the level of the recesses in the upper edges of the base and screw means extending through the guide posts and being threadedly engaged therewith whereby on rotation of the screw means the side posts are moved toward or away from each other.

9. A gun sight for combat shooting and the like, comprising a base portion having opposite sides extending in the direction of sight, the bottom of which is adapted to fit on the front of a gun, a centrally located vertically extending blade-type center post which is longer in the direction of sight than it is high vertically and having a beveled upper front corner secured to the front end of the base centrally between the sides of the base, side posts extending vertically above the base a distance greater than the height of the center post and extending along both sides of the base in the direction of the line of sight substantially twice the dimension of extent of the center post along the line of sight, the front upper edge of the side posts being rounded and the rear upper edge of the side posts from the top of the base being beveled toward the front of the side posts, which bevel is terminated prior to the rear of the center post, the base being provided with recesses on both upper edges thereof extending along the line of sight and rectangular guide portions extending perpendicular to the direction of sight across each of the recesses, the side posts are provided with a complementary recess fitting over the guide portions, side plates are secured to the sides of the base below the side posts, and screw means extend through the side plates and into the base at the level of the recesses in the upper edges of the base, the screw means extending through the side posts and being threadedly engaged therewith whereby on rotation of the screw means the side posts are moved toward and away from the center post.

* * * * *